United States Patent [19]

Kim et al.

[11] 4,374,048

[45] Feb. 15, 1983

[54] ELECTRICALLY CONDUCTIVE POLYMERIC COMPOSITIONS

[75] Inventors: Oh-Kil Kim, Burke, Va.; Robert B. Fox, Bethesda, Md.

[73] Assignee: The United States of America as represented by the Secretary of the Navy, Washington, D.C.

[21] Appl. No.: 291,001

[22] Filed: Aug. 7, 1981

[51] Int. Cl.[3] ..... H01B 1/06

[52] U.S. Cl. ..... 252/500; 252/511; 252/514; 252/518; 252/521; 525/59; 525/61; 525/295; 525/377; 524/204; 524/236; 524/557

[58] Field of Search ..... 252/500, 511, 518, 512, 252/514, 521; 260/37 R, 37 M; 525/59, 61, 295, 377; 524/204, 236, 557

[56] References Cited

U.S. PATENT DOCUMENTS

| | | | |
|---|---|---|---|
| 3,424,698 | 1/1969 | Lupinski | 252/500 |
| 4,293,452 | 10/1981 | Fox et al. | 252/518 |

OTHER PUBLICATIONS

Journal American Chem. Society, "Substituted Quinodimethans", Hertler et al., vol. 84, pp. 3474–3478.

*Primary Examiner*—J. L. Barr

*Attorney, Agent, or Firm*—Robert F. Beers; William T. Ellis; Thomas E. McDonnell

[57] ABSTRACT

An electrically conductive composition comprises a poly (vinylacetal) polymer, a TCNQ salt uniformity dispersed throughout the polymer, and optionally a plasticizer.

26 Claims, 3 Drawing Figures

ELECTRICALLY CONDUCTIVE POLYMERIC COMPOSITIONS

BACKGROUND OF THE INVENTION

The present invention pertains generally to electroactive materials and in particular to organic polymeric conductive materials.

Presently, numerous metals and other inorganic substances are used to fabricate electrical conductors, semiconductors, electronic devices, and electromagnetic or acoustic sensors. The utility of these materials is frequently limited by such factors as weight, mechanical fragility, fabrication problems, corrosion, scarcity, and high costs.

Many organic materials have properties which overcome or minimize these problems and possess several other advantages, such as ease of fabrication into films, filaments, and complex shapes and variability in molecular design. Of particular importance is the possibility with organic materials to fabricate electronic devices whose dimensions are "molecular", such as diodes, capacitors, and gates whose dimensions are in the range of 10 Å to 500 Å.

Numerous resinous compositions that conduct electricity are known. Many of them comprise an organic resin with a conductive material, e.g., a metal or graphite, dispersed in a resin. Due to a lack of chemical bonding and the discreteness of the conductive filler, the mechanical properties are not good and loading the polymeric binder with sufficient filler to produce a polymeric conductor with sufficient conductivity to meet the requirements of many applications is often not possible. Further, metallic corrosion can deteriorate the conductivity of the composition. Metals and graphite are not transparent and their inclusion prevents the fabrication of a transparent conductor.

One type of conductive resin includes radical-anion salts of 7,7,8,8-tetracyanoquinodimethane (TCNQ) which are themselves organic semiconductors. A complex salt, $M^+(TCNQ)_2^{\pm}$, is also used and is preferred on account of a higher conductivity than the corresponding simple salt, $M^+TCNQ^{\cdot-}$. The properties of polymeric semiconductors of the polycation-TCNQ type have some advantages over their monomeric derivatives in that they are processable and their conductivity can be controlled by varying the TCNQ concentration. However, the matrix polymer is brittle due to its ionic nature, and its stability is lowered by sensitivity to moisture. Another approach is to disperse TCNQ salts into non-ionic matrix polymers so that advantage can be taken of the mechanical properties and higher stabilities of the polymer; however, compatibility, stability, and dispersion problems still remain.

SUMMARY OF THE INVENTION

It is, therefore, an object of the present invention to obtain a high electrical stability in a conductive polymeric composition.

Another object is to provide an electrically conductive polymeric composition which is highly environmentally stable and resistant to oxidation by air.

And another object of this invention to achieve high mechanical strengths in an electrically conductive polymeric composition.

A further object of the present invention is to provide an electrically conductive composition which is easy to process and has excellent fiber-forming capabilities.

These and other objects are achieved by incorporating a TCNQ salt into poly(vinylacetal) polymers, having, attached to the acetal carbon thereof, an electron-rich moiety of an ionic strength such that the charge-transfer interaction between the salt and the moiety provides excellent electronic stability and facilitates dispersion of the salt throughout the polymer.

DETAILED DESCRIPTION OF THE INVENTION

Figure 1:
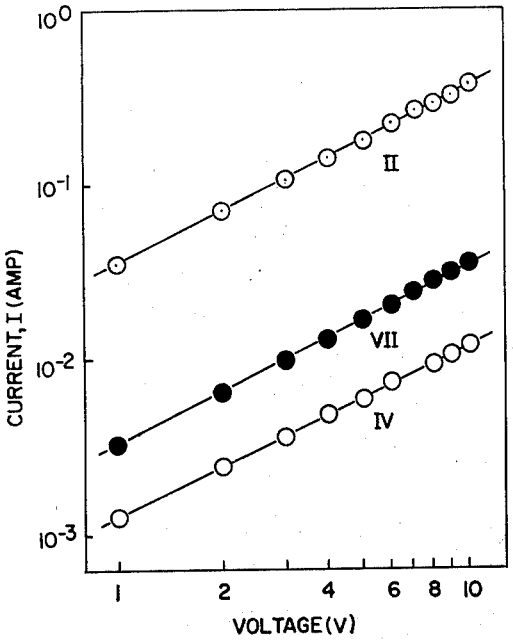
FIG. 1 is a graphical representation of the current-voltage relation in several TCNQ salt-poly(vinylacetal) systems.

The polymeric matrix is a poly(vinylacetal) polymer with an electron-rich donor moiety on the acetal carbon. These polymers can be easily prepared from commercially available poly (vinyl alcohol) by the general reaction, represented as follows:

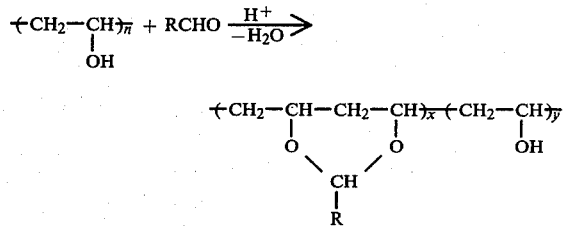

The molecular weight should be at least about 10,000. For most applications the molecular weight would be from about 20,000 to about 50,000. Consequently the values of n,x, and y which represent the number of repetitions for their respective units are determined by the molecular weight of the starting and product polymers. The ratio of x to y is from about 9:1 to about 1:9 with 8:1 to 2:1 preferred and 7:1 to 7:3 most preferred.

The aldehyde reactant provides the electron-rich donor moiety on the acetal carbon. Since the strength of the moiety strongly affects the dispersion of the TCNQ salts throughout the matrix and the resistivity of the polymeric composition, the ionization potential of the aldehyde is of great importance. Experimentation has shown that the ionization potential should be from about 7 to about 10 eV and preferably from 7 to 8.5 eV. The preferred aldehydes are anthraldehyde, phenanthraldehyde, naphthaldehyde, N-alkylcarbazolecarboxaldehyde, quinolinecarboxaldehyde, dialkylaminobenzaldehyde wherein the alkyl groups have from 1 to 4 carbon atoms and furaldehyde, thiophenecarboxaldehyde, indolecarboxaldehyde, and alkylbenzaldehyde wherein the number of alkyl groups is from 1 to 5 and an alkyl group has from 1 to 4 carbon atoms and the most preferred aldehydes are N-ethyl-3-carbazolecarboxaldehyde (ECZ), naphthaldehyde 9-anthraldehyde (ANT), 2-furaldehyde (FA), 2 or 3-thiophenecarboxaldehyde (TCA), indole-3-carboxaldehyde (ICA), 4-quinolinecarboxaldehyde (QUNA), an alkyl benzaldehyde (ABA) wherein the number of alkyl groups is from 1 to 5 an alkyl group has from 1 to 3 carbon atoms, and p-(dimethylamino)benzaldehyde (DMBA). Thus "R" represents radicals derived from naphthalene, anthracene, phenanthrene, N,N-dialkylaminobenzene, N-alkyl-3-carbazole, and quinoline, wherein the alkyl groups have from 1 to 4 carbon atoms, furan, thiophene, indole, and alkylbenzene.

The TCNQ salts dispersed throughout the polymeric matrix is represented by the formula:

$$X^{M+}[TCNQ^{\dot{-}}]_m \quad [TCNQ^{\circ}]_n$$

wherein X is a metal or a cation radical, m is 1 or 2 and n is 0 or 1. The preferred metals are lithium, sodium, potassium, beryllium, magnesium, calcium, strontium, manganese, copper, silver, and tin and the most preferred metals are lithium, sodium, potassium, copper, and silver. The preferred cation radicals are ammonium trialkylammonium, and N-alkylquinolium wherein the number of carbon atoms are from 1 to 4. The most preferred radicals are ammonium ($NH^+$), triethylammonium ($NHEt_3^+$), and N-ethylquinolium.

The TCNQ salts can be easily prepared by, e.g. the method disclosed in Melby et al. *J. Am. Chem. Soc.* 84, 3374 (1962). These materials can be easily characterized by methods such as elemental analysis and IR and visible spectra.

Although the presence of any concentration of the salt would improve the conductivity of a poly(vinylacetal) polymer of this invention, the TCNQ salt concentration for a practical organic semiconductor is at least about 5 wt. % and preferably from 10 wt. %, based on total composition weight. The most preferred minimum, as well as maximum concentration, depends on the polymeric matrix. It is theorized that the variation in resistivity with the matrix at a fixed concentration is due to the differences in chemical changes in the solid as a result of the interaction between the salt and the individual matrix polymer.

Increasing the concentration of the TCNQ salt increases the conductivity up to a point, but it also decreases the mechanical strength of the polymer. Thus TCNQ salt concentrations as high as 50 wt. % can be used, but preferably the TCNQ salt concentration does not exceed 40 wt. %. The most preferred maximum concentration would depend on the matrix and, to a degree, on the intended use.

The conducting polymeric compositions of this invention are prepared by mixing the TCNQ salt with a poly(vinylacetal) polymer in a solvent selected from the class consisting of dimethylformamide DMF and dimethylsulfoxide DMSO, at a temperature from about 0° to about 100° C. and evaporating the solvent at a lowered pressure or by vacuum until the composition is dry. The rate of drying, like the TCNQ concentration, affects the formation of salt crystallites the size of the crystallites and the dispersion of those crystallites throughout the polymer; generally, a fast drying rate suppresses the crystallite formation. As is shown in Table 3, the film conductivity of the present system is strongly influenced by the drying rate, a slow drying rate facilitating crystallite formation and thus producing a microcrystallite network. As a result, a slow drying rate enhances the conductivity of the present system. Generally a drying rate producing a drying time of at least about 1.5 hours is the fastest drying rate. If the rate exceeds this, the conductivity is seriously affected. The preferred drying time is at least 2 hours and most perferably at least 3 hours. Practicalities and economic considerations require that the drying time does not exceed three hours.

In preparing the conducting polymeric compositions of this invention, an additional amount of TCNQ° can be added to the solution. The amount can be from about 2 to about 30 wt. % and preferably from 2 to 15 wt. %. The processability of the polymeric composition can be improved by the addition of a plasticizer in an amount from about 5 to about 30 percent of the total composition weight and preferably from 10 to 20 weight percent. The preferred plasticizers are polyethylene oxide (PEO), polypropylene oxide (PPO), and other alkylene oxides.

The invention having been generally described is demonstrated by the following examples. It is understood that these examples are given by way of example and are not intended to limit this specification and the claims to follow in any manner.

The TCNQ salts in the following examples were prepared by the method disclosed in Melby et al., infra. The poly(vinylacetals) were synthesized from poly(vinyl alcohol) (PVA) having 99% saponification and a molecular weight of about 25,000.

EXAMPLE 1-I

Reaction of ECZA with PVA

The aldehyde, ECZA, 22.3 g (0.1 mole) was dissolved in 130 ml dimethylformamide (DMF) in which was suspended 3.3 g (0.075 mole) of pulverized PVA, and p-toluenesulfonic acid hydrate, 2.5 g (0.013 mole) was added. The mixture was warmed up to 80° C. with stirring. In about 3 hours the solution became homogeneous. After 20 hours the solution was poured into a large amount of acetone to precipitate a grey-colored polymer. Dissolution in dimethylformamide (DMF) and precipitation with acetone and then with water was repeated several times. Finally the precipitated polymer was filtered, washed with acetone, and dried under reduced pressure to give a slightly greyish solid (5 g). The nitrogen analysis, 4.26%, corresponded to 71% acetalization; IR (solid film): $\nu_{CH}$ 3050, 2920 and 2870 $cm^{-1}$; $\delta_{CH}$ 1480 and 1420 $cm^{-1}$; $\nu_{COC}$, 1270 $cm^{-1}$; $\nu_{OCO}$, 1120 and 1020 $cm^{-1}$ and $\nu_{CO}$, 935 $cm^{-1}$.

EXAMPLES 1-II-VII

Other poly(vinyl acetals) from aldehydes such as 9-anthraldehyde (ANT), 4-quinolinecarboxaldehyde (QUNA), and p-(dimethylamino) benzaldehyde (DMBA) were synthesized as described above. The basic aldehydes QUNA and DMBA were neutralized with the acid used as catalyst, with an excess acid performing the catalyst function. At the conclusion of the heating period in these cases, the reaction mixture was poured into a large volume of water and neutralized with sodium acetate.

The conditions of the acetalization, including Example I, and the analytical results are given in Table I. As before the reactants of the examples were dissolved in 130 ml of dimethylformamide (DMF). The reaction was allowed to proceed for 20 hours except for ECZA-2 (8 hours) and ECZA-3 (4 hours). All of the examples, except QUNA which used concentrated sulfuric acid, used p-toluenesulfonic acid. Acetalization was determined from the formula: $100[2\times/(2x+y)]$ where x and y are the mole fractions of acetal and hydroxyl units.

TABLE 1

Reaction Conditions and Analyses for Poly(vinyl acetals)

| Example | RCHO | RCHO mole | PVA mole | Acid mole | % N | % Acetalization |
|---|---|---|---|---|---|---|
| 1-I | ECZA-1 | 0.1 | 0.075 | 0.018 | 4,26 | 39 |
| 1-II | ECZA-2 | 0.1 | 0.15 | 0.013 | 3.28 | 40 |
| 1-III | ECZA-3 | 0.1 | 0.15 | 0.013 | 3.11 | 36 |
| 1-IV | ANTA | 0.1 | 0.075 | 0.008 | a | 39 |
| 1-V | DMBA | 0.1 | 0.075 | 0.13 | 3.29 | 30 |
| I-VI | QUNA | 0.03 | 0.03 | 0.04 | 5.39 | 46 |
| I-VII | NA | 0.13 | 0.097 | 0.008 | b | 66 |

a - % C 73.37, % H 6.66
b - % C 75.00, % H, 67

EXAMPLES 2-I-XVII

Preparation of Conducting Film

The aldehyde, ECZA, 47 mg, was dissolved in 2.0 ml of dry dimethylformamide (DMF) that had been purged with dry nitrogen and then a weighed amount of the TCNQ salt was added to the solution. Stirring the green solution was continued for several hours to several days at room temperature. Films were cast by spreading the solution on a glass or aluminum plate and evaporating the solvent over a period of about two hours at approximately 30° C. under reduced pressure at 12 mmHg. The resulting film was further dried at 40° C. in vacuo overnight. A smooth black-green film is formed with a uniform dispersion of heavily inter-connected microcrystals, often in a fan shape. The thickness of film samples for the electric measurement was in the range of 3 to $5\times10^{-3}$ cm. Anhydrous conditions were used in the film preparation because water reacts with TCNQ and its salts. Other compositions were prepared, formed into films by this method and tested. Table 2 summarizes the results for these examples and designates a matrix as p(aldehyde). Thus the matrix polymer formed from ECZA would be P(ECZA). The electrical resistance of the conducting film was measured with Keithly 610C electrometer in most cases. The film was made up as a surface-type cell; on both sides of the film were Au-vapor-deposited electrodes whose diameter was 2.0 cm. The d.c. current induced under various applied voltages was measured in air at room temperature. The resistance of the conducting film was calculated by Ohm's law. Ohmic behavior was observed in all conducting films. The resistivity was computed from $p=R\ A/d$, where R is the measured resistance (Ω), A is the area of the electrode in $cm^{-2}$, and d is the sample thickness in cm. For a four-probe method a Keithley 164 TT digital multimeter was used in the milliohmeter mode. Four-probe and two-probe measurements gave approximately identical resistivity values. The temperature dependence of the electrical resistance was measured in vacuo in a temperature controlled chamber. Activation energies were determined from Arrhenius plots obtained by measuring the resistance (R) at 5° intervals over 10° to 50° C. The activation energy, $E_a$ was computed from the relation:

$$R=R_o \exp (E_a/kT)$$

where $R_o$ is the resistance at infinite temperature, k is the Boltzmann constant, and T is the absolute temperature.

TABLE 2

Sample Compositions and Electrical Properties

| Example | Polymer | | TCNQ° | (Ω-cm) | Ea(eV) |
|---|---|---|---|---|---|
| | | $NHEt_3^+(TCNQ)_2^-$ | | | |
| 2-I | P(ECZA)-1 | 0.24(10.8) | — | $2.5\times10^8$ | 0.094 |
| 2-II | P(ECZA)-1 | 0.48(19.5) | — | $1.5\times10^4$ | 0.078 |
| 2-IIa | P(ECZA)-2 | 0.48(19.5) | — | $3.6\times10^4$ | 0.11 |
| 2-III | P(ECZA)-1 | 0.95(32.7) | — | $7.2\times10^3$ | — |
| 2-IV | P(ECZA)-1 | 0.24(10.4) | 0.24(4.1) | $4.4\times10^4$ | 0.065 |
| 2-V | P(ECZA)-1 | 0.24(9.8) | 0.59(9.8) | $2.9\times10^4$ | 0.048 |
| 2-VI | P(ANT) | 0.24(0.4) | 0.24(4.1) | $7.8\times10^7$ | 0.41 |
| 2-VII | P(DMBA) | 0.24(10.4) | 0.24(4.1) | $2.7\times10^5$ | 0.22 |
| 2-VIII | PMMA | 0.24(10.4) | 0.24(4.1) | $5.0\times10^6$ | — |
| 2-IX | PAN | 0.24(10.4) | 0.24(4.1) | $8.9\times10^8$ | — |
| 2-X | P(NA) | 0.12(5.6) | 0.12(2.2) | $1.2\times10^5$ | — |
| 2-XI | P(BA) | 0.12(5.6) | 0.12(2.2) | $5.0\times10^5$ | — |
| | | $K^+TCNQ^{\dot{-}}$ | | | |
| 2-XII | P(ECZA)-1 | 0.44(9.6) | — | $5.2\times10^{10}$ | — |
| 2-XIII | P(ECZA)-1 | 0.44(8.9) | 0.44(7.2) | $9.1\times10^6$ | — |
| 2-XIV | P(ECZA)-1[a] | 0.44(6.2) | 0.44(5.0) | $4.5\times10^5$ | — |
| 2-X | P(ANTA) | 0.44(8.9) | 0.44(5.0) | $1.1\times10^8$ | — |
| 2-VI | PMMA | 0.44(9.6) | — | $1.8\times10^{11}$ | — |
| 2-VII | PMMA | 0.44(8.9) | 0.44(5.0) | $1.9\times10^7$ | — |

[a]320 mg. (19.0 wt %) PEO added per g. P(ECZA)-1.

Figure 2:
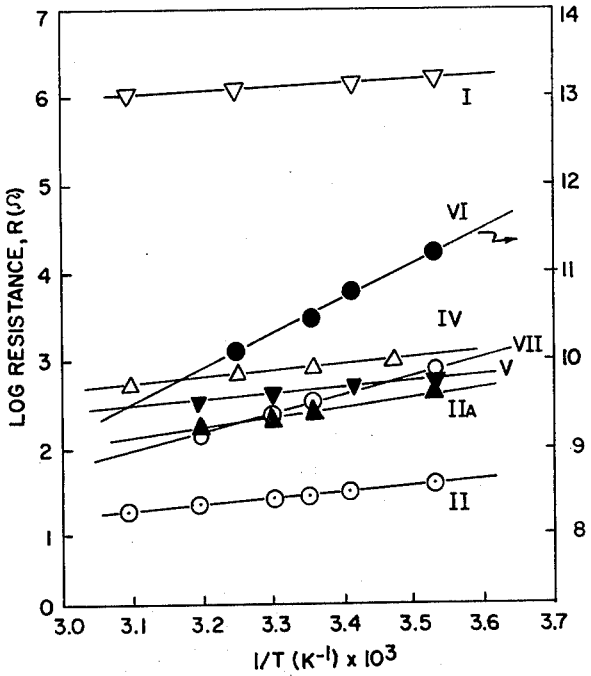
FIG. 2 is a graphical representation of the temperature dependence of electrical resistance of several TCNQ salt-poly (vinylacetal) systems.

All polymer samples of the present system showed linear current-voltage characteristics regardless of the nature of the polymer and the concentration of components; examples are illustrated in FIG. 1. The temperature dependence of the electrical resistance shown in FIG. 2 is typical of semiconductors.

Electrical conduction in these films may depend in part on the formation of a continuous network of uniformly dispersed conducting species into the polymer matrix. The uniformity of the dispersion of the added conducting species is probably a consequence of interaction between those species and the matrix polymer. If there were no or negligible interaction between them, the conductivity would be independent of the chemical structure of the polymer. Conductivity is, however, highly dependent on the polymer matrix, as shown in Table 2. Among the vinyl acetal polymers, N-ethylcarbazolyl and N,N-dimethylaminophenyl moieties are electrically-active components in the matrix, unlike the anthracenyl moiety. Poly(vinyl-4-quinolinealdehyde acetal), P(QUNA), was found to be as electrically active as P(ECZA).

The results show that the addition of neutral TCNQ to the simple salt, $K^+TCNQ^{\dot{-}}$, increased the conductivity (Examples 2-XII-XIII and 2-XVI-XVII). Addition of poly(ethylene oxide) (PEO), whose effects for plasticization and interaction were expected to enhance the compatibility of a TCNQ salt with a matrix polymer, also increased the conductivity of the K salt dispersion to some extent (Examples 2-XIII=XIV).

As shown in Examples I–III in Table 2, conductivity in the $NHEt_3^+(TCNQ)_2^-$/P(ECZA)-1 system increases with increasing concentrations of the added TCNQ salt up to about 20 wt%; little further effect is observed with additional increments of the salt. Up to 40% by weight of TCNQ salt in P(ECZA), the conductivity is uniform throughout the entire film, but above that concentration the films become heterogeneous and the flexibility lessened. Such observations indicate that there is a saturation in the dissolution of TCNQ salt in the polymer matrix. The level of saturation, e.g. in poly(methylmethacrylate) PMMA and poly(acrylonitrile) PAN was found to be much lower than that in the poly(vinylacetals), because the phase separation took place at lower TCNQ salt concentrations.

An unusual effect was observed when TCNQ° was added to a complex salt. As shown in Examples I, IV, and V in Table 2, the resistivity of the $NHEt_3^+(TCNQ)_2^{\dot{-}}$ /P(ECZA)-1 system was lowered to $4\times10^{-4}$ from $2\times10^{-8}$ Ω-cm by introducing only 4% by wt TCNQ° but additional TCNQ° did not further decrease the resistivity. The decreasing resistivity with increasing TCNQ° is probably due to the activation energy.

Figure 3:
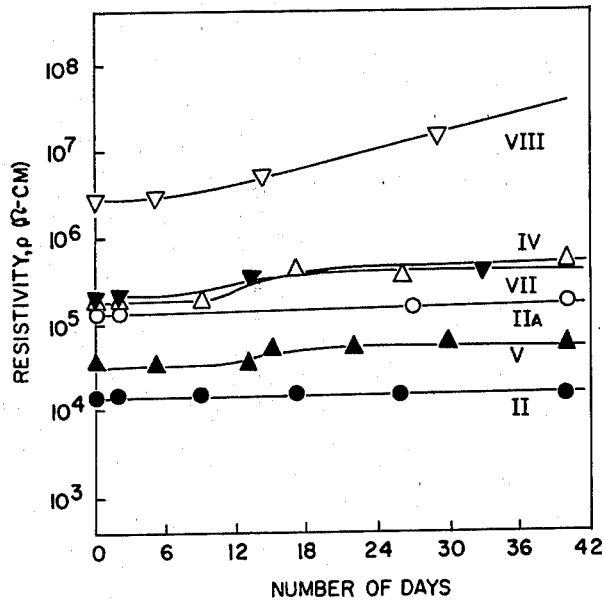
FIG. 3 is a graphical representation of resistivity changes in TCNQ-salt conducting films as a function of time.

The electrical stability of the conductive films was examined in air at room temperature as a function of time; the data are shown in FIG. 3. It was found that P(ECZA) and P(DMBA) are useful matrix polymers for stability as well as conductivity. Among them, the P(ECZA) system was the most stable one; only negligible changes in resistivity in these films occurred over a period of almost two months.

To demonstrate the effect of the drying rate additional examples were made and are summarized in Table 3.

TABLE 3

| System | | | ρ(Ω-cm) Evaporation | | Film Morphology Evaporation | |
|---|---|---|---|---|---|---|
| $Et_3NH^+(TCNQ)_2$ (mmol/g. polymer) | TCNO° | Polymer | 12mmHg | 1mmHg | 12mmHg | 1mmHg |
| 0.48 | — | P(ECZA) | $1.5\times10^4$ | $1.2\times10^9$ | MC +++ | Neg. Crystals |
| 0.24 | 0.24 | P(ECZA) | $4.4\times10^4$ | — | MC +++ | — |
| 0.12 | 0.12 | P(NA) | $1.2\times10^5$ | $1.5\times10^{12}$ | MC ++ | No Crystals |
| 0.12 | — | P(BA) | $3.2\times10^6$ | $3.3\times10^9$ | MC ++ | MC + |
| 0.12 | 0.12 | P(BA) | $4.9\times10^5$ | $5.8\times10^7$ | MC ++ | MC + |

MC-microcrystals
+ - Indicates Crystal Density

Throughout the specification and the claims to follow an amount expressed as weight percent is a percent of the total composition weight. Obviously numerous modifications and variations of the present invention are possible in light of the above teachings. It is therefore to be understood that within the scope of the appended claims the invention may be practiced otherwise than as specifically described therein.

What is claimed as new and secured by Letters Patent of the United States is:

1. A cured electrically conductive polymeric composition consisting essentially of a poly(vinylacetal) polymer represented by the general formula:

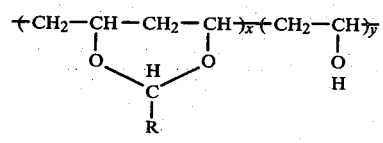

wherein R is a radical of the base of an electron-rich donor aldehyde having an ionization potential from about 7 to about 10 eV, the ratio of x to y is from about 9:1 to about 1:9, and an amount up to about 50 weight percent of microcrystals of a salt represented by the formula:

$$X^{M+}[TCNQ^{\dot{-}}]_m \quad [TCNQ^{\circ}]_n$$

wherein x is a metal or a cation radical, said metal being selected from the group consisting of lithium, sodium, potassium, beryllium, magnesium, calcium, strontium, manganese, copper, silver and tin, and said cation radical being selected from the class consisting of ammonium, trialkyl-ammonium, N-alkylquinolium radicals with alkyl groups from 1 to 4 carbon atoms, m is 1 or 2, and n is 0 or 1.

2. The polymeric composition of claim 1 wherein R is a radical of an electron-rich donor aldehyde compound having an ionization potential from 7 to 10 eV.

3. The polymeric composition of claim 2 wherein the ionization potential of said donor compound is from 7 to 8.5.

4. The polymeric composition of claim 1 wherein R is selected from group consisting of radicals of naphthalene, anthracene, phenanthrene, N,N-dialkylaminobenzene, N-alkyl-3-carbazole, quinoline, furan, thiophene, indole, wherein an alkyl group has from 1 to 4 carbon atoms, and alkyl benzene wherein the number of alkyl groups is from 1 to 5 and an alkyl group has from 1 to 4 carbon atoms.

5. The polymeric composition of claim 4 wherein R is selected from the group consisting of radicals of naphthalene, anthracene, N,N-dimethylaminobenzene, N-ethyl-3-carbazole, and quinoline.

6. The polymeric composition of claim 4 wherein R is selected from the group consisting of radicals of dimethylaminobenzene, N-ethyl-3-carbazole, and quinoline.

7. The polymeric composition of claim 5 wherein said salt is in an amount from about 5 to about 50 weight percent.

8. The polymeric composition of claim 5 wherein said salt is in amount from about 10 to about 40 weight percent.

9. The polymeric composition of claim 6 wherein said salt is in amount from about 5 to about 50 weight percent.

10. The polymeric composition of claim 6 wherein said salt is in amount from 10 to 40 weight percent.

11. The polymeric composition of claim 1 wherein X is selected from the group consisting of lithium, sodium, potassium, $NH_4^+$, $NH(Alk)_3^+$ wherein Alk is a lower alkyl from 1 to 4 carbon atoms, and N-alkyl-quinolium wherein said alkyl has from 1 to 4 carbon atoms.

12. The polymeric composition of claim 2 wherein X is selected from the group consisting of lithium, sodium, potassium, $NH_4^+$, $NH(Alk)_3^+$ wherein Alk is a lower alkyl from 1 to 4 carbon atoms, and N-alkyl-quinolium wherein said alkyl has from 1 to carbon atoms.

13. The polymeric composition of claim 5 wherein X is selected from the group consisting of lithium, sodium, potassium, $NH_4^+$, $NH(Alk)_3^+$ wherein Alk is a lower alkyl from 1 to 4 carbon atoms, and N-alkyl-quinolium wherein said alkyl has from 1 to 4 carbon atoms.

14. The polymeric composition of claim 6 wherein X is selected from the group consisting of lithium, sodium, potassium, $NH_4^+$, $NH(Alk)_3^+$ wherein Alk is a lower alkyl from 1 to 4 carbon atoms, and N-alkyl-quinolium wherein said alkyl has from 1 to 4 carbon atoms.

15. The polymeric composition of claim 7 wherein X is selected from the group consisting of lithium, sodium, potassium, $NH_4^+$, $NH(Alk)_3^+$ wherein Alk is a lower alkyl from 1 to 4 carbon atoms, and N-alkyl-quinolium wherein said alkyl has from 1 to 4 carbon atoms.

16. The polymeric composition of claim 8 wherein X is selected from the group consisting of lithium, sodium, potassium, $NH_4^+$, $NH(Alk)_3^+$ wherein Alk is a lower alkyl from 1 to 4 carbon atoms, and N-alkyl-quinolium wherein said alkyl has from 1 to 4 carbon atoms.

17. The polymeric composition of claim 9 wherein X is selected from the group consisting of lithium, sodium, potassium, $NH_4^+$, $NH(Alk)_3^+$ wherein Alk is a lower alkyl from 1 to 4 carbon atoms, and N-alkyl-quinolium wherein said alkyl has from 1 to 4 carbon atoms.

18. The polymeric composition of claim 10 wherein X is selected from the group consisting of lithium, sodium, potassium, $NH_4^+$, $NH(Alk)_3^+$ wherein Alk is a lower alkyl from 1 to 4 carbon atoms, and N-alkyl-quinolium wherein said alkyl has from 1 to 4 carbon atoms.

19. The polymeric composition of claim 8 wherein x is selected from the group consisting of sodium, potassium, ammonium, $NH(Eth)_3^+$, wherein Eth is the ethyl radical.

20. The polymeric composition of claim 10 wherein x is selected from the group consisting of sodium, potassium, $NH_4^+$, and $NH(Eth)_3^+$, wherein Eth represents the ethyl radical.

21. The polymeric composition of claim 7, 9, 15, or 17 wherein the ratio of x to y is from 8:1 to 2:1.

22. The polymeric composition of claim 8, 10, 16, 18, or 20 wherein the ratio of x to y is from 7:1 to 7:3.

23. A method of preparing the polymeric composition of claim 1 which comprises mixing a TCNQ salt with a poly(vinylacetal) polymer in a solvent selected from the class consisting of dimethylformamide DMF and dimethylsulfoxide DMSO at a temperature from about 0° to 100° C. and evaporating said solvent at a rate such that microcrystallites of said salt are formed throughout said polymer.

24. The method of claim 23 wherein said rate of evaporation is such that said composition is dry no sooner than about 1.5 hours.

25. The method of claim 24 wherein said composition is dry after about 1.5 to about 3 hours.

26. The method of claim 24 wherein said composition is dry after about 2 to about 3 hours.

* * * * *